United States Patent [19]

Thomas

[11] Patent Number: 4,951,932

[45] Date of Patent: Aug. 28, 1990

[54] ADJUSTMENT MECHANISM FOR WORK CLAMPING

[76] Inventor: Jim R. Thomas, 8844 - 31st Ave., Kenosha, Wis. 53142

[21] Appl. No.: 407,562

[22] Filed: Sep. 15, 1989

[51] Int. Cl.[5] ..... B25B 1/02

[52] U.S. Cl. ..... 269/212

[58] Field of Search ..... 269/210–212, 269/45, 91–94, 64, 82–85, 71

[56] References Cited

U.S. PATENT DOCUMENTS

| | | | |
|---|---|---|---|
| 1,345,177 | 6/1920 | Heckathom | 269/64 |
| 1,740,934 | 12/1929 | Raymond | 269/210 |
| 2,204,837 | 6/1940 | Waller | 269/64 |
| 2,803,277 | 8/1957 | Gamura | 269/212 |

*Primary Examiner*—Robert C. Watson

*Attorney, Agent, or Firm*—Peter N. Jansson

[57] ABSTRACT

The improved adjustment mechanism for work clamping includes a support member which is arranged for attachment to a supporting arm. The support member has a plurality of serrations which are regularlhy spaced across a generally planar support face formed on the support member. A clamping member is arranged for attachment to a locator block and includes a plurality of serrations regularly spaced across a generally planar clamp face. The clamping member is adjustably movable with respect to the support member. A tension member such as a bolt maintains the serrations of the support face and the clamp face in fixed positional engagement with one another when the mechanism is used for work clamping. The tension member is releasable for permitting adjustment of the position of the clamping member relative to that of the support member.

9 Claims, 7 Drawing Sheets

ADJUSTMENT MECHANISM FOR WORK CLAMPING

FIELD OF THE INVENTION

This invention is related generally to work clamping and, more particularly, to an improved adjustment mechanism whereby the position of a clamping face may be adjusted in any one or more of three axes and/or rotationally.

BACKGROUND OF THE INVENTION

Depending upon the task to be performed, the degree of accuracy to which the position of a clamping face must be adjusted ranges from roughly approximate to extremely precise. An example of the former is a bench vise wherein the work piece is positioned only approximately and the location of the operation to be performed thereon is more closely determined by the vise user. An example of a work clamping tool used for this purpose is shown in U.S. Pat. No. 1,121,531. Examples of other work clampings devices which include an adjustment feature are shown in U.S. Pat. Nos. 1,666,079 and 2,494,424. While used for position adjustment rather than work clamping, another form of adjustment mechanism is shown in U.S. Pat. 2,027,888.

Certain industrial manufacturing processes require that clamping of a work piece be performed with somewhat greater precision than is possible with the common bench vise. In addition, such processes often require clamping of work pieces having random thicknesses. Sometimes such pieces must be clamped in one of several positions and/or from one side only, i.e., against the horizontal working surface of a bench. Devices known as step clamps, step blocks, toe clamps and gripper buttons are made for such purposes and are available from Monroe, Jergens, Applied Mechanics Corp. and Carr Lane Manufacturing Company. While clamping tools of these types provide somewhat more flexibility and precision than a common a bench vise, they are wholly unsuited for sophisticated, high production work clamping applications.

One of the most demanding work clamping applications arises in the automotive industry. The construction of vehicle bodies requires that two sheet metal body parts be clamped in precise relative location one to the other while they are being attached to one another by spot welding or carbon dioxide welding. Such precision alignment is necessary for several reasons. First, the overall appearance and saleability of the-vehicle is improved when its sheet metal body parts are carefully and precisely joined to one another. The customer is therefore likely to be much more satisfied with the appearance of the vehicle and to recommend a similar purchase to others.

Precision of sheet metal assembly is also required since the various cavities defined by the body shell must receive and have attached thereto a wide variety of carefully formed interior and exterior vehicle components. Dashboard assemblies, window regulators and seats are among those components requiring closely and accurately fitted sheet metal body parts in order to assure final assembly which is both workmanlike and of neat appearance.

Such automotive work clamping applications not only demand precision clamping but rapidity of adjustability is also of critical importance. Time spent in tool adjustment is non-productive and impairs the progress of high speed assembly lines. The cost per unit downtime in an auto assembly line is enormous and therefore is to be avoided if at all possible.

In the automotive industry, sheet metal body parts are usually clamped between a pedestal mounted stationary locator block and another locator block mounted on a movable clamp arm. The clamp arm, in turn, is supported by a hand clamping mechanism or by a hydraulic or pneumatic automatic clamping mechanism, the latter types often being found in high rate production applications.

A significant factor affecting the precision with which sheet metal parts are clamped for welding attachment is that such parts, especially larger, contoured parts, tend to vary slightly in size and shape and between successive set ups.

For each set-up run of sheet metal panels to be joined, the relative positions of the fixed and movable locator blocks must be quickly and precisely selected. This is so since there will be slight variances, set-up to set-up, in the shape of a given sheet metal part. Quick, precise positioning of locator blocks dramatically reduces downtime. In addition, the clamping arrangement must also secure the sheet metal parts for welding without marring or otherwise deforming the metal surface. To do otherwise may impair the quality and appearance of the exterior finish.

A common approach to the problem of precise locator block positioning is to form the structure of the block supporting pedestals using multiple pieces bolted together in one or more planes. By so doing, the precise location of the locator block may be adjusted by the insertion of shims, thin pieces of metal inserted between the interfaced surfaces of the structure which supports a particular locator block. For example, the stationary structure supporting a nest locator block is constructed to have a base and a locating nest which are bolted together and which are arranged to receive one or multiple shims between their interfaced surfaces. This permits selection of the precise final clamping position of the nest locator block. Similarly, the movable clamp locator block and the supporting clamp arm are bolted together and constructed to permit the interposition of shims whereby the final clamping position of the movable locator block may be precisely selected.

Clamping structures which support the locator blocks are manufactured in a wide variety of shapes and bolt hole patterns. In fact, a single welding fixture may employ clamping structures requiring shims of varying perimeter shapes and varying cut-out patterns to accommodate the wide variety of clamping structures and bolt hole patterns used therein. For these reasons, an automotive body assembly plant will be required to stock dozens if not hundreds of different sizes, shapes and thickness of shims for this purpose.

When an adjustment of the position of locator blocks is required to be made, the maintenance person must first assure that shims of the correct size, thickness and bolt pattern are on hand. To perform the actual adjustment, bolts are loosened on the clamping structure and shims are added or removed to both the stationary pedestal and to the movable clamping structure until both locator blocks are positioned as desired. The time required to perform such adjustments is very significant and the need to stock such a wide variety of shims presents an imposing inventory and purchasing burden.

Yet another disadvantage arising from such an arrangement is that because the adjustment procedure is relatively complicated, painstaking and time consuming, there is a significant chance that it will be performed incorrectly. Poorly assembled sheet metal body components and customer dissatisfaction will be the result. An adjustment mechanism for work clamping which is easy and quick to use, which is capable of accurately positioning locator blocks and which eliminates the need for adjustment shims would be a distinct advance in the art.

OBJECTS OF THE INVENTION

It is an object of this invention to provide an improved adjustment mechanism for work clamping which overcomes some of the problems and shortcomings of the prior art.

Another object of this invention is to provide an improved adjustment mechanism for work clamping which eliminates the use of adjustment shims.

Another object of this invention is to provide an adjustment mechanism which may be quickly and accurately adjusted to accommodate slight variations in automotive sheet metal body parts.

Another object of this invention is to provide an improved adjustment mechanism useful to adjust a locator block in any one or more of three axes of movement.

Still another object of this invention is to provide such an adjustment mechanism which also permits adjustment of the angular location of a locator block.

Still another object of the invention is to provide an improved adjustment mechanism for work clamping which lends itself to use in high production automotive assembly lines.

Still another object of this invention is to provide an improved adjustment mechanism which may be used by persons of relatively modest mechanical skills.

These and other important objects will be apparent from the descriptions of this invention which follow.

SUMMARY OF THE INVENTION

The inventive adjustment mechanism for work clamping dramatically improves the ability of maintenance personnel to easily, accurately and quickly adjust the position of locator blocks for work clamping purposes. While the invention finds general utility, it will be particularly advantageous in the assembly of sheet metal parts used to make automobile and other motor vehicle bodies. The adjustment mechanism may be used to position a locator block in any one or more of three different axes. The mechanism may also be constructed to permit rotary positional adjustment, either alone or in conjunction with linear adjustment along one or more axes movement.

In general, the improved adjustment mechanism for work clamping includes a support member which is arranged for attachment to a supporting arm. The support member has a plurality of serrations which are regularly spaced across a generally planar support face formed on the support member. A clamping member is arranged for attachment to a locator block and includes a plurality of serrations regularly spaced across a generally planar clamp face. The clamping member is adjustably movable with respect to the support member. A tension member such as a bolt maintains the serrations of the support face and the clamp face in fixed positional engagement with one another when the mechanism is used for work clamping. The tension member is releasable for permitting adjustment of the position of the clamping member relative to that of the support member.

In a preferred embodiment, the clamping member has an elongate slot formed in it for receiving a bolt which extends through the clamping member to engage a threaded hole in the support member. For a bolt of a given diameter, the length of the slot will determine the range of adjustability of the position of the clamping member with respect to that of the support member. With the bolt slightly loosened, the serrations may be disengaged and the position of the clamping member adjusted with respect to that of the support member. The spacing of the serrations will determine the minimum increment of adjustment. When the bolt is tightened, the support member and the clamping member are maintained in fixed relative positions.

In a highly preferred embodiment, the support face and the clamp face, portions of the support member and clamping member, respectively, are generally planar, parallel to the axis of adjustable movement and perpendicular to the longitudinal axis of the bolt.

Rapid adjustment of the position of a locator block will be facilitated if movement of each clamping member is confined to a single axis. Stated another way, it is preferred that the clamping member be prevented from moving laterally along an axis parallel to the edges of the serrations but rather, be movable only along an axis normal thereto. Accordingly, a highly preferred adjustment mechanism will include a guide for preventing such lateral movement and, preferably, the guide comprises a part of the support member, either integrally or by being rigidly attached thereto.

The improved adjustment mechanism has a high degree of user flexibility in that an adjustment set, made up of a support member and its companion clamping member, may be cascaded with one or more additional adjustment sets. Each adjustment set permits positioning of the associated locator block along a separate axis of movement. From the detailed description, it will be understood that the use of three adjustment sets will permit positioning movement of the associated locator block in three separate axes of movement, each being normal to the other two.

An adjustment set may also be constructed to permit angular positioning of a locator block. Such an adjustment set would include a generally disc shaped support member and matching clamping member. Radial serrations are formed in the support face and the clamp face. A bolt extends through a center hole in the clamp block and is received in a central threaded hole in the support block. Loosening the bolt slightly will permit angular positioning of the clamp block with respect to the support block, whereupon the bolt is re-tightened prior to the commencement of assembly work.

DETAILED DESCRIPTIONS OF PREFERRED EMBODIMENTS

The figures depict an improved adjustment mechanism 10 for work clamping.

Figure 1:
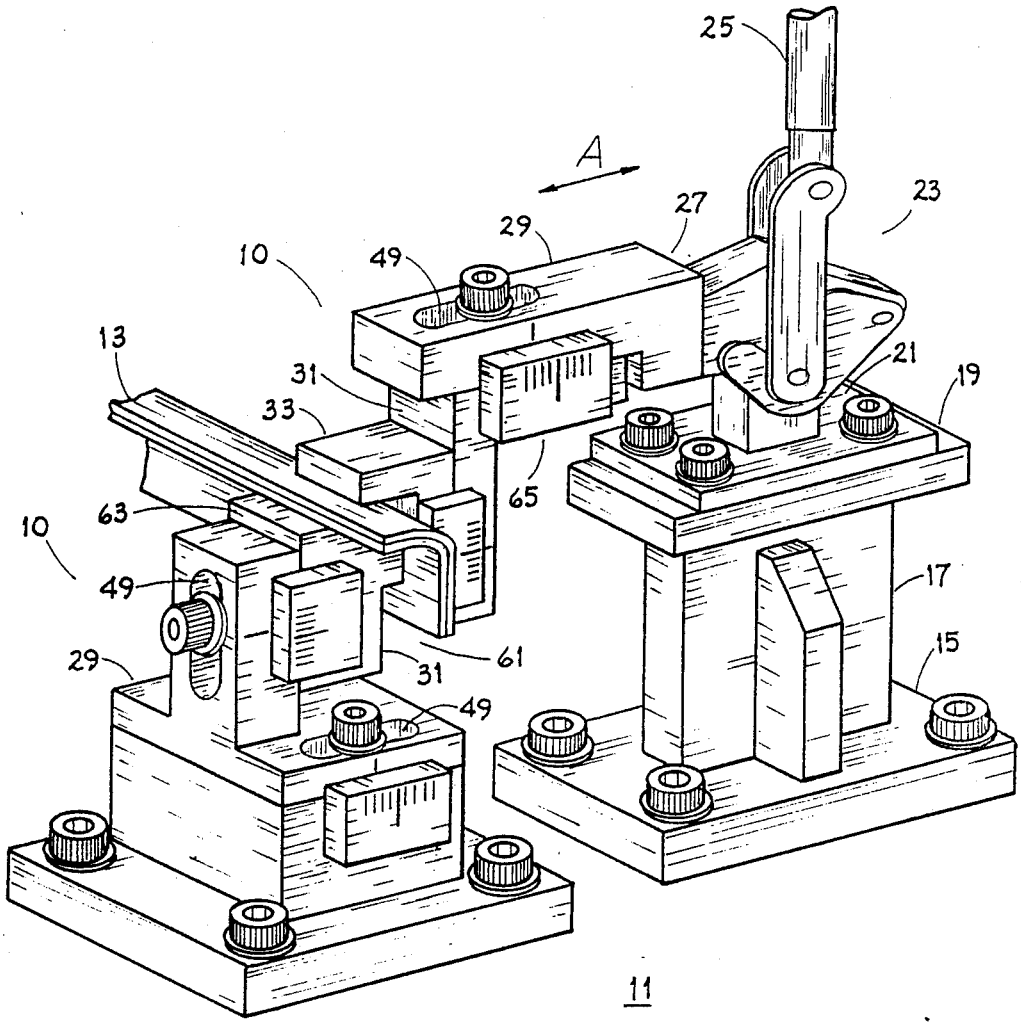
FIG. 1 is a perspective view of the adjustment mechanism shown in conjunction with a structure for clamping sheet metal parts.

Referring to FIGURE 1, the adjustment mechanism 10 is shown in conjunction with structure 11 for clamping exemplary sheet metal parts 13 in precise location to one another while a welding operation is performed to join those parts 13. Actual clamping structures may be arranged differently, may be operated by hydraulic or pneumatic cylinders and may be highly automated. However, the fundamental principles of such structures are the same and all have a need for periodic adjustability to accommodate slight variations in the shape or thickness of sheet metal parts 13 being welded. It is to be understood that the depiction of FIG. 1 is somewhat simplified for more clearly explaining the mechanism 10.

The structure 11 is embodied as clamp base 15 and includes an upwardly extending clamping pedestal 17 having base plate 19 and mounting plate 21. A clamp mechanism 23 is attached to mounting plate 21 and movement of handle 25 through an arc will cause movement of the attached clamping arm 27 toward or away from sheet metal parts 13 to be clamped. A support member 29 is arranged for attachment to supporting clamp arm 27, either by welding thereto or by forming support member 29 and clamp arm 27 as a unitary structure as shown. A clamping member 31 is arranged for attachment to clamp locator block 33 and is adjustably movable on support member 29 parallel to axis A.

As described below, and for example each member 29, 31 has a serrated face. Prior to cutting the serrations, the face is generally planar and after cutting, this face is still defined by the outwardly protruding edges of the serration teeth. Reference to a face in this way facilitates explanation of how members 29, 31 co-act to provide quick, easy adjustment.

Figure 3:
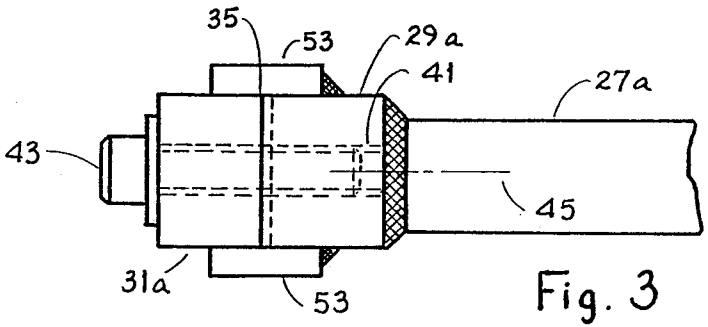
FIG. 3 a top plan view of the apparatus of FIG. 2 taken along the viewing plane 3—3 thereof, with parts shown in phantom.
Figure 2:
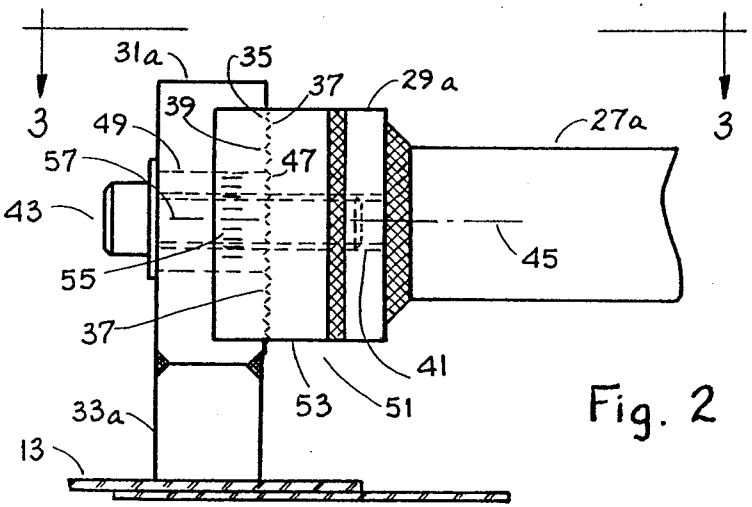
FIG. 2 is a side elevation of an adjustment mechanism shown in conjunction with its associated locator block and support arm, with parts broken away and other parts shown in phantom.

Referring additionally to FIGS. 2 and 3, support member 29*a* is attached to arm 27*a* and has a generally planar support face 35 with a plurality of regularly spaced serrations 37 cut into face 35. Each serration 37 includes a notch cut in face 35 and each pair of adjacent notches defines a ridge like tooth 39 protruding outward. Each notch is cut to a uniform depth in face 35, is linear, and is spaced at a uniform distance from adjacent notches. When cut in this way, resulting teeth 39 will likewise be linear and uniformly spaced and will have their outwardly extending edges coincident with the plane of face 35. As will be better understood from the following, the spacing between adjacent teeth 39 will determine the minimum increment of adjustable movement of clamping member 31*a*.

The support member 29*a* also includes threaded hole 41 for receiving a tension member such as bolt 43 to secure clamping member 31*a* and support member 29*a* in fixed engagement with one another when work is being performed. In a highly preferred embodiment, longitudinal axis 45 of hole 41, and of bolt 43 threaded into it, will be normal to the support face 35. The clamping member 31*a* includes a clamp face 47 in which is formed a plurality of linear, regularly spaced serrations 37. The serrations 37 formed in clamping member 31*a* conform dimensionally to those formed in support member 29*a* so as to tightly engage one another, much like gear teeth, when the bolt 43 is tightened. The clamping member 31 includes an elongate slot 49 which has a width selected to receive the shank of bolt 43 with very slight clearance. The length of slot 49 is selected in view of the bolt diameter and the maximum adjustment dimension which is desired. Bolt is received through slot 49, extends through the clamping member 31*a* and threadably engages tapped hole 41 in support member 29*a*.The bolt 43 is releasable by unscrewing, thereby permitting serrations 37 on support face 35 and clamp face 47 to be disengaged one from the other. The clamping member 31*a* may thereupon be adjustably moved to a new position if desired.

To prevent lateral movement of clamping member 31*a* along an axis parallel to the teeth 39, the support member 29*a* will include a guide 51 which is either welded thereto or formed as an integral part thereof. The guide 51 includes a pair of rectangular guide plates 53, the interior surfaces of which are spaced to permit closely fitted, sliding movement of clamping member 31*a* while yet preventing lateral movement of member 31*a* parallel to the serrations 37, i.e., up and down movement as viewed in FIG. 3.

In a highly preferred embodiment, one or both of guide plates 53 will include adjustment lines 55 scribed on the side thereof with spacing between each adjacent pair of lines 55 being equal to the spacing between adjacent pair of teeth 39. An indicator line 57 is scribed on clamping member 31*a* for visually determining the amount by which the clamping member 31*a* is moved with respect to the support member 29*a*.

From the foregoing, one may readily appreciate the ease and accuracy with which a locator block 33*a* may be positioned in one axis of movement. The use of shims is made entirely unnecessary and the job of locator block position adjustment is no longer a significant factor in measuring automotive assembly line downtime. The descriptions below will show how the fundamental principles explained above may be used to make an adjustment mechanism 10 with additional capabilities.

Referring again to FIG. 1, the arrangement of the structure 11 will be more easily understood in view of the foregoing explanation. The structure 11 also includes a nest base 59, at least one nest adjustment set 61 and a nest locator block 63. The base 59, adjustment set 61 and block 63 operate in conjunction with base 15, clamp adjustment set 65 and block 33 for clamping sheet metal parts 13 therebetween in closely aligned engagement. After being so clamped, the parts 13 are joined by welding.

From the foregoing, it should also be understood that certain variations are possible in the construction of adjustment mechanism 10. For example, elongate slot 49 may be formed in support member 29 as shown in FIG. 1 rather than in clamping member 31*a* as shown in FIGS. 2 and 3. Similarly, threaded hole 41 which receives bolt 43 may be formed in clamping member 31 as is apparent from FIG. 1 rather than in support member 29*a* as shown in FIGS. 2 and 3.

Figure 5:
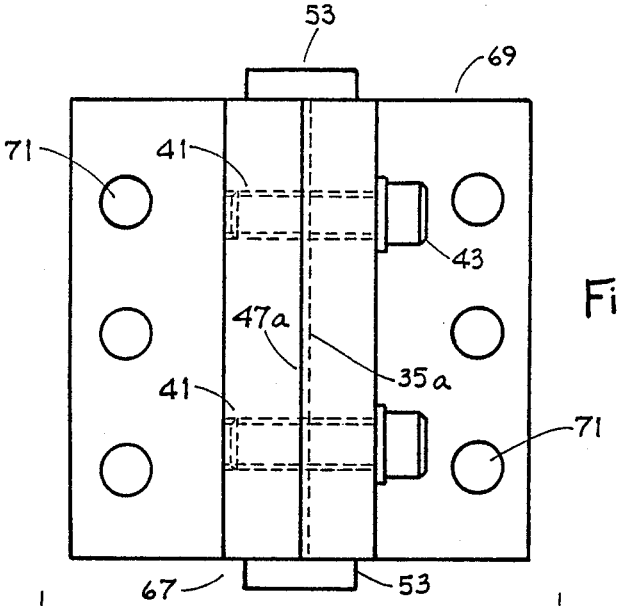
FIG. 5 is a top plan view of the apparatus of FIG. 4 taken along the viewing plane 4—4 thereof, with parts shown in phantom.
Figure 4:
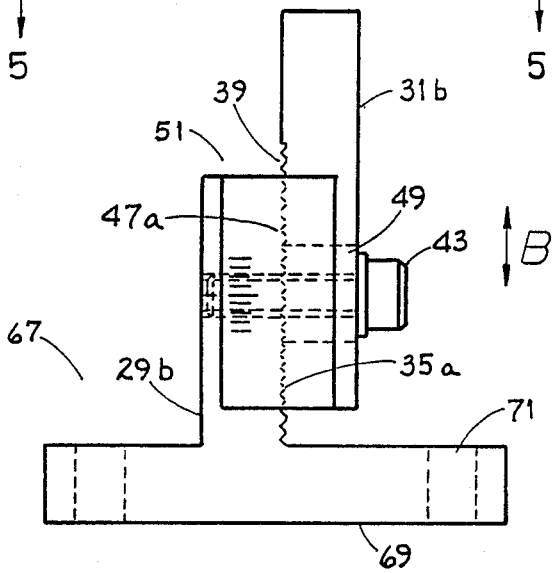
FIG. 4 is an end elevation view of an adjustment mechanism shown in conjunction with its related support structure, with parts shown in phantom.

FIGS. 1, 4 and 5 illustrate how the adjustment mechanism 10 may be incorporated into a pedestal 67. The pedestal 67 includes a base plate 69 with bolt holes 71 for attaching plate 69 to a surface, either stationary or movable. A support member 29*b* extends upwardly from base plate 69 and includes a serrated face 35*a*, a guide 51 comprised of guide plates 53 and a threaded hole 41 for receiving a bolt 43. The clamping member 31*b* likewise includes a serrated face 47*a* and an elongate slot 49 for permitting relative movement of the clamping member 31*b* with respect to the support member 29*b*. As shown in FIG. 4, the movement of clamping member 31*b* will be up and down, i.e., parallel to axis B since the edges of teeth 39 are parallel to base plate 69. If pedestal 67 and clamping member 31*b* are of significant width, both are formed to accommodate two bolts 43 as shown for more secure attachment.

Figure 7:
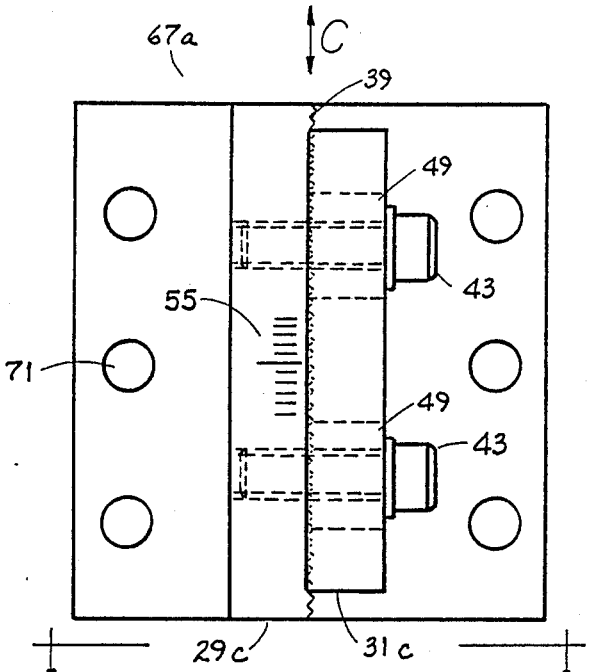
FIG. 7 is a top plan view of the apparatus of FIG. 6 taken along the viewing plane 7—7 thereof, with parts shown in phantom.
Figure 6:
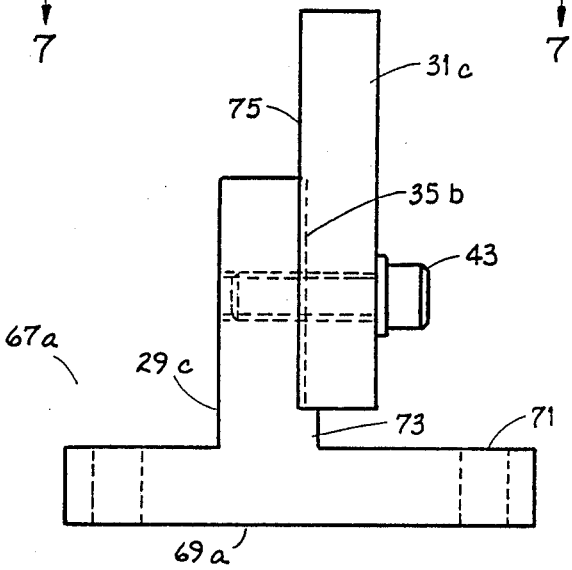
FIG. 6 is an end elevation view of another embodiment of an adjustment mechanism shown in conjunction with its related support structure, with parts shown in phantom.

FIGS. 1, 6 and 7 illustrate how the adjustment mechanism 10 may be incorporated into a pedestal 67*a* in another way. In this configuration, base plate 69*a* includes an upwardly extending support member 29*c* which has a serrated face 35*b*. The teeth 39 defining this face 35*b* are parallel to base plate 69*a*. A shoulder 73 projects outwardly from face 35*b* and the clamping member 31*c* is located in sliding engagement with shoulder 73. The shoulder 73 therefore functions as a guide 51 to help confine the movement of clamping member 31*c* along an axis C, up and down as viewed in FIG. 7 or normal to the paper as viewed in FIG. 6.

Elongate slots 49 permit relative movement of clamping member 31*c* upon support member 29*c* when bolts 43 are loosened. When tightened, bolts 43 cause the serrated face 35*b* of support member 29*c* to engage face 47*b* of clamping member 31*c* to retain the relative position of the members 29*c*, 31*c*. In the illustrated configurations adjustment lines 55 may be scribed on the top surface of support member 29*c* while a single indicator line (not shown) is scribed on the vertical face 75 of the clamping member 31*c*. The amount of adjustment can thereby be visually determined.

Figure 10:
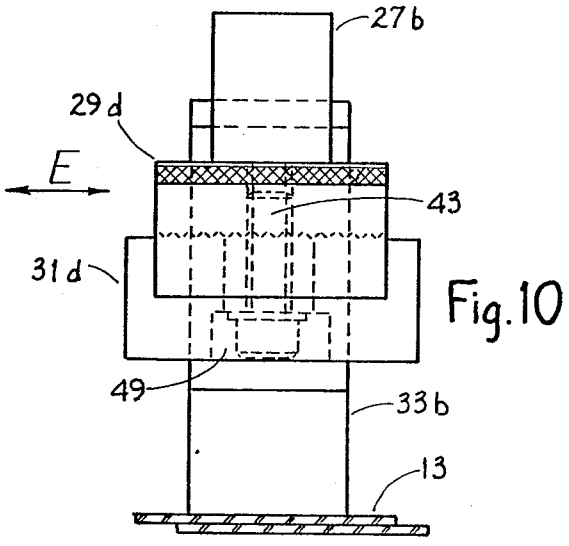
FIGURE 10 is an end elevation view of the apparatus shown in FIG. 8 taken along the viewing plane 10—10 thereof with parts shown in phantom.
Figure 9:
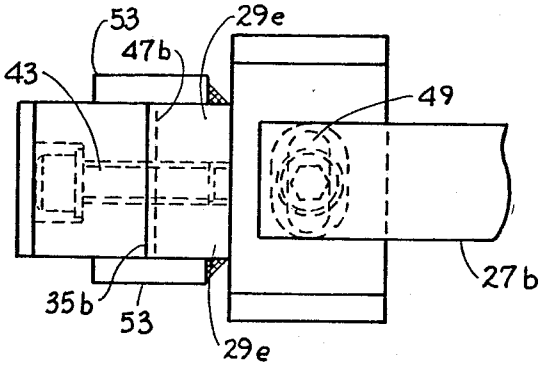
FIG. 9 is a top plan view of the apparatus shown in FIG. 8 taken along the viewing plane 9—9 thereof, with parts broken away and other parts shown in phantom.
Figure 8:
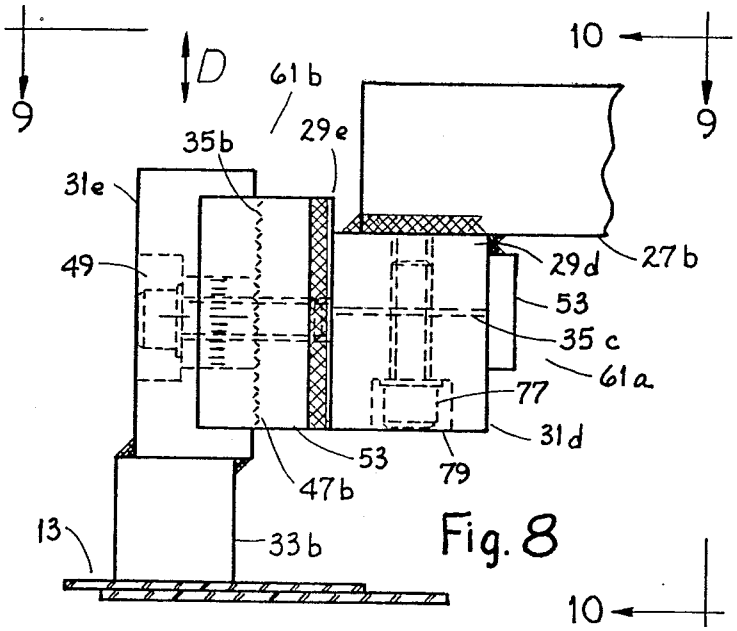
FIG. 8 is a side elevation of two adjustment mechanisms shown in cascade and in conjunction with the associated locator block and support arm, with parts broken away and other parts shown in phantom.

FIGS. 8, 9 and 10 illustrate how the adjustment mechanism 10 may be ganged or cascaded to permit positioning of a locator block 33*b* in either one or both of two axes. A support member 29*d* is attached to arm 27*b*, by welding, for example, and oriented so that its serrated face 35*c* is parallel to the plane of the sheet metal parts 13 to be welded. An outer guide plate 53 is attached to support member 29*d* for guiding the outer surface of clamping member 31*d*, while the inner surface of clamping member 31*d* is guided by the rear plane of the adjacent support member 29*d*. In this configuration, bolt head 77 is received in recessed cavity 79 which provides additional working space in which to manipulate an Allen wrench to tighten or loosen bolt 43. The length of elongate slot 49 determines the maximum range of adjustable movement of clamping member 31*d* with respect to support member 29*d*. Details of the construction of the support member 29*d* and the clamping member 31*d* used to make up each adjustment set 61*a*, 61*b* are similar to those described above.

Another adjustment set 61*b* includes a companion support member 29*e* with its guide plates 53 attached thereto and a clamping member 31*e* with its serrated face 47*b* oriented to engage the serrated face 35*b* of the support member 29*e*. With this cascaded arrangement having two adjustment sets 61*a*, 61*b*, the locator block 33*b* may be positioned in either one or both of two axes of movement, axis D and/or axis E.

Figure 12:
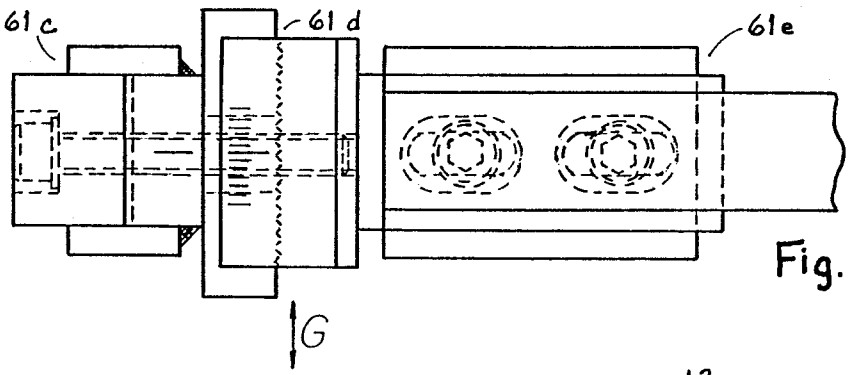
FIG. 12 is a top plan view of the apparatus shown in FIG. 11 taken along the viewing plane 12—12 thereof, with parts broken away and other parts shown in phantom.
Figure 11:
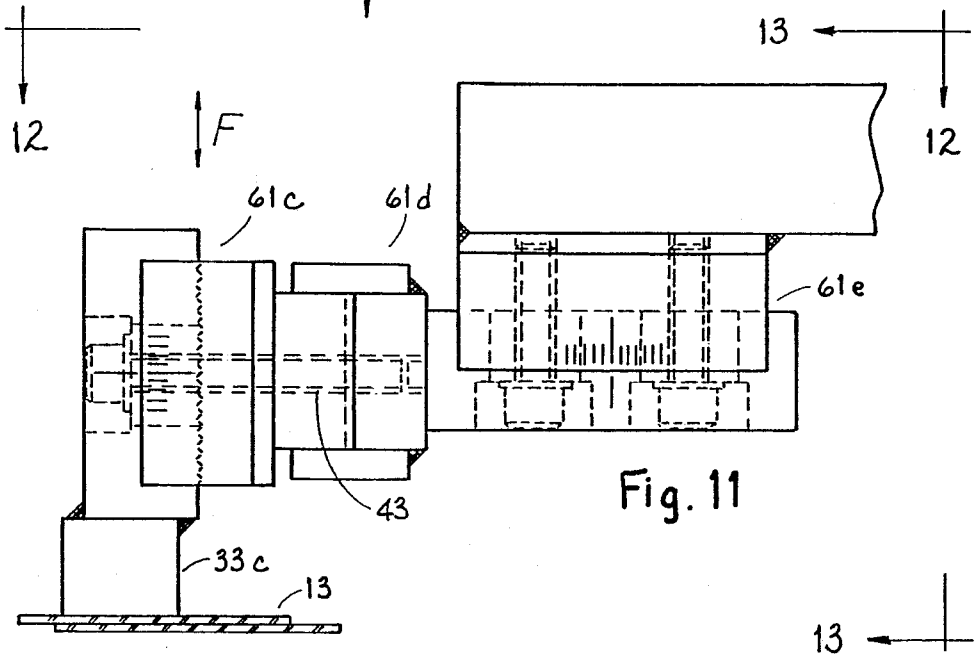
FIG. 11 is a side elevation of three adjustment mechanisms shown in cascade and in conjunction with the associated locator block and support arm, with parts broken away and other parts shown in phantom.
Figure 13:
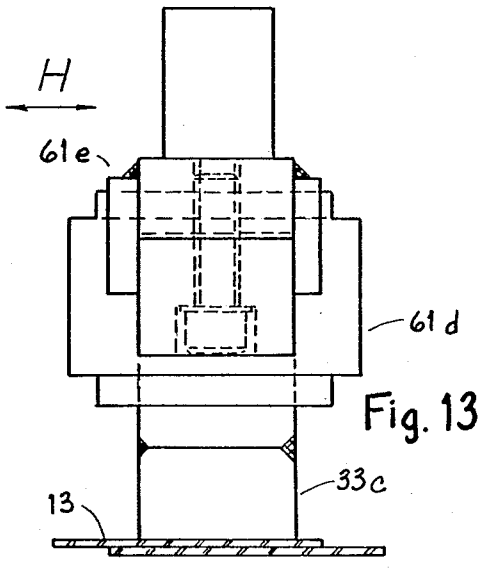
FIGURE 13 is an end elevation view of the apparatus shown in FIGURE 11 taken along the viewing plane 13—13 thereof and with parts shown in phantom.

FIGS. 11, 12 and 13 illustrate yet another way in which the inventive adjustment mechanism 10 may be used to provide positioning movement of a locator block 33*c* in three axes of movement. The arrangement includes a first adjustment set 61*c* for permitting movement along axis F, a second adjustment set 61*d* for permitting movement along axis G and a third adjustment set 61*e* which permits movement along axis H. These axes F, G, H of adjustable movement may be used singly or in any combination. It will also be observed that the first and second adjustment sets, sets 61*c* and 61*d* respectively, are maintained in engagement by a single bolt 43. Arrangements of the adjustment mechanism 10 which have been described thus far will permit positioning a locator block 33,63 along an axis of movement for each adjustment set 61 used.

Figure 14:
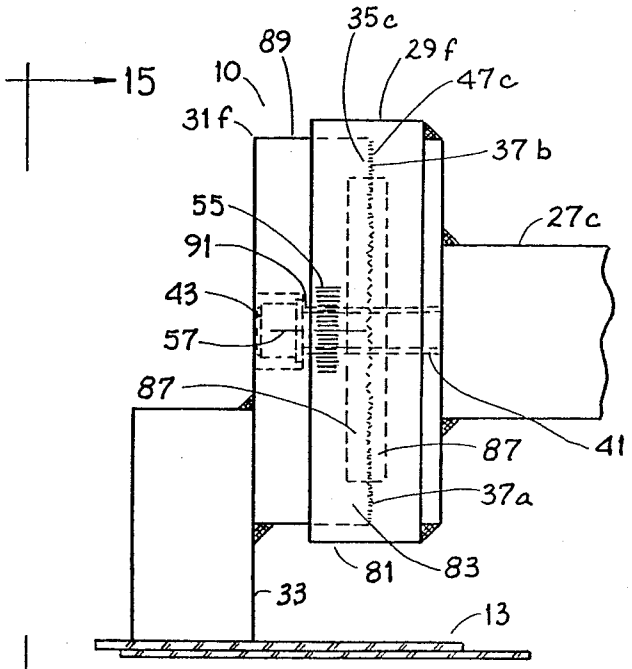
FIG. 14 is a side elevation of another embodiment of the adjustment mechanism which permits angular or rotational adjustment.,shown in conjunction with its associated locator block and support arm, with parts broken away and other parts shown in phantom.
Figure 15:
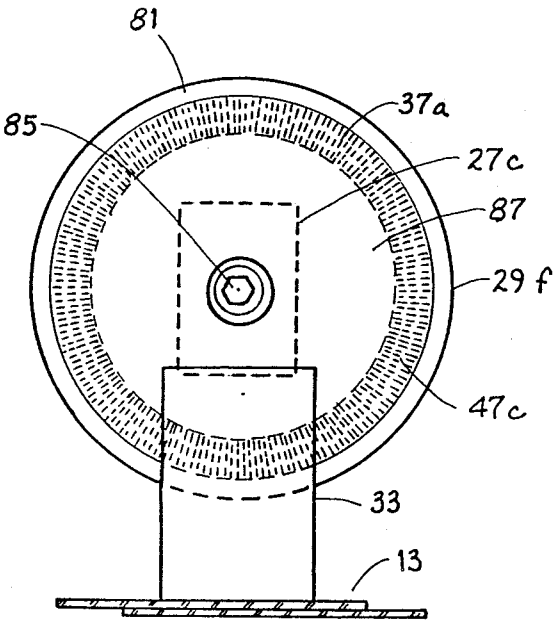
FIG. 15 is an end view of the apparatus shown in FIG. 14 taken along the viewing plane 14—14 thereof and with the clamping member omitted to show interior details of construction of the support member, and with parts shown in phantom.

However, the inventive mechanism 10 is not limited to linear adjustment. FIGS. 14 and 15 illustrate how the adjustment mechanism 10 may be configured to permit angular or rotational rather than linear adjustment of the position of a block 33, 63. A support member 29*f* is arranged for attachment to a supporting clamp arm 27*c* and includes a plurality of regularly spaced serrations 37*a* formed in a generally planar support face 35*c*. Clamping member 31*f* is arranged for attachment to a locator block 33 (or 63) and includes a plurality of regularly spaced serrations 37*a* formed in a generally planar clamp face 47*c*. A tension member such as a bolt 43 maintains support face 35*c* and clamp face 47*c* in fixed positional engagement with one another when the mechanism 10 is used for work clamping. The bolt 43 is releasable for permitting rotational, angular adjustment of the position of clamping member 31*f* relative to that of the support member 29*f*.

In a highly preferred embodiment, the support member 29*f* is generally disc-shaped and has an outwardly extending circular rim 81 and interior face 35*c* which cooperate to define a cavity 83. Regularly spaced serrations 37*a* are formed radially in the face 35*c* and while these serrations 37*a* may be formed to extend from the rim 81 to the center point 85, machining will be simplified and performance will be unimpaired if each serration 37*a* defines a shortened radial segment. To improve the ease with which these radial serrations 37*a* may be machined or otherwise formed in the face 35*c*, a relief pocket 87 of increased depth is included. A threaded hole 41 is concentrically formed in the support member 29*f* for receiving bolt 43. A series of regularly spaced adjustment lines 55 are etched along the outer circumference of rim 81 and as described below, are used in conjunction with an indicator line 57 for visually determining the amount of adjustment.

The clamping member 31*f* is also formed to be generally disc shaped and will have a diameter selected so that it may be received in closely fitted, sliding engagement with the interior surface of the rim 81. When so configured, rim 81 functions as a guide to confine movement of the clamping member 31*f* to rotary motion only. The clamping member 31*f* also includes a generally planar face 47*c* into which regularly spaced notches or serrations 37*b* have been radially formed. The clamping member 31*f* likewise includes a relief pocket 87 so that the serrations 37*b* are of segmented length rather than extending from the outer edge 89 to the center point 85. A round, untapped hole 91 is formed in clamping member 31*f* to receive the bolt 43 with very slight clearance. For improved appearance, the bolt head may be recessed into a cavity 79.

When support member 29*f* and clamping member 31*f* are assembled as shown in FIG. 14, bolt 43 may be released by loosening it slightly so that serrations 37*a*,37*b* of support member 29*f* and clamping member 31*f* disengage. The clamping member 31*f* may then be rotationally positioned with respect to the support member 29*f* and the bolt 43 re-tightened. The faces 35*c*, 47*c* of support member 29*f* and clamping member 31*f* shown in FIGS. 14 and 15 are shown to be parallel to one another and normal to the longitudinal axis of the bolt 43. However, these faces 35*c*, 47*c* may also be angularly oriented to define what may be viewed as a very short truncated cone (not shown), so long as they conformably securely engage on another when the bolt 43 is tightened. The adjustment mechanism 10 shown in FIGS. 14 and 15 is especially useful to provide accurately positioned clamping across the entire work face of locator block 33, 63 in those situations where the face may be out of parallel with the face of the sheet metal parts 13 being joined .

From the foregoing description taken in conjunction with the FIGURES, it should be understood that the terms "support member" and "clamping member" are used to denote and distinguish the two portions of an "adjustment set". In so describing these portions, it is not necessarily to be concluded that these members directly provide support or clamping functions. However, in all cases described above, the support member will be that portion of an adjustment set 61, 65 which includes a guide, either in the form of guide plates, a shoulder or a rim, and will also include at least one threaded hole for receiving a bolt.

It should also be understood that while a bolt 43 is a highly preferred form of tension member, a support member 29 and a clamping member 31 may be maintained in engagement by a structure which will have a portion thereof in tension and which may be equally effective, even though significantly more cumbersome and expensive. For example, a support member 29 and a clamping member 31 may have their serrated faces 35, 47 maintained in fixed engagement by a separate C-clamp, for example.

It should also be appreciated that as to any adjustment set 61, 65, serrations 37 formed in support face 35 and clamp face 47 are comformably sized and shaped so that support member 29 and clamping member 31 are maintained in secure engagement when bolt 43 is tightened. However, different adjustment sets 61, 65 may have serrations 37 which are more widely or narrowly spaced, depending upon the minimum adjustment dimension which may be required using that adjustment set.

While the principles of this invention have been described in connection with specific embodiments, it should be understood clearly that these descriptions are made only by way of example and are not intended to limit the scope of the invention.

What is claimed is:

1. An improved mechanism for clamping a work piece in a stationary position while work is being performed thereon, the mechanism including:

a support member attached to a supporting arm and having a horizontal, generally planar support face, said support face including a plurality of serrations regularly spaced thereacross;

a clamping member releasably engaged with said support member and having a horizontal, generally planar clamp face, said clamp face including a plurality of serrations regularly spaced thereacross, said serrations on said clamp face being releasably engaged with said serrations on said support member, thereby permitting adjustment of the position of said clamping member with respect to that of said support member;

said clamping member further including a vertical, generally planar face with a plurality of serrations regularly spaced thereacross;

a locator block releasably engaged with said clamping member, said locator block having a vertical, generally planar face with a plurality of serrations regularly spaced thereacross, said vertical face of said locator block being releasably engaged with said vertical face of said clamping member, thereby permitting adjustment of the position of said locator block with respect to that of said clamping member;

said support member and said clamping member thereby permitting adjustment of said position of said locator block along a horizontal axis prior to clamping said work piece, said clamping member and said locator block thereby permitting adjustment of said position of said locator block along a vertical axis prior to clamping said work piece.

2. The mechanism of claim 1 wherein said support member, said clamping member and said locator block are supported by a clamp base.

3. The mechanism of claim 2 further including a tension member for maintaining said support face and said clamp face in fixed positional engagement with one another when said mechanism clamps said work piece, said tension member being releasable for permitting adjustment of said position of said locator block along said horizontal axis, thereby avoiding the use of shims to achieve such adjustment.

4. A mechanism for clamping at least two sheet metal automotive body parts in contact with one another and in a stationary position during welding by a welding tool, such clamping being between a nest locator block which is stationary and a clamp locator block which is movable to effect clamping, the mechanism including:

a nest base having at least one nest adjustment set for supporting said nest locator block and adjusting its position;

a clamp base having at least one clamp adjustment set for supporting said clamp locator block and adjusting its position;

each of said adjustment sets including:

a support member having a plurality of serrations formed in a horizontal support face;

a clamping member having a plurality of serrations formed in a horizontal clamp face for engaging said horizontal serrated support face of said support member, said clamping member being adjustably movable with respect to said support member prior to clamping;

at least one bolt for maintaining said support member and said clamping member of a said adjustment set in fixed positional engagement with one another when the mechanism is in use for work clamping, said bolt being releasable for permitting adjustment during setup of the position of a said clamping member relative to that of a said support member;

the apparatus thereby permitting accurate positioning of said nest locator block and said clamp locator block prior to clamping said sheet metal parts therebetween.

5. The mechanism of claim 4 wherein said support member of at least one of said adjustment sets includes a guide for confining the movement of its associated said clamping member along an axis which is generally normal to the edges of the teeth embodied in said serrations.

6. An improved mechanism for clamping a work piece in a stationary position while work is being performed thereon, the mechanism comprising: a clamp base;

said clamp base having a first clamp arm attached thereto, said first clamp arm having a first support member attached thereto, said first support member having a horizontal, generally planar support face with a plurality of serrations regularly spaced thereacross;

a clamping member releasably attached to said support member and having a horizontal, generally planar clamp face, said clamp face including a plurality of serrations regularly spaced thereacross, said serrations on said clamp face being releasably engaged with said serrations on said support member thereby permitting horizontal adjustment of the position of said clamping member with respect to that of said support member;

said clamping member further including a vertical, generally planar face and a plurality of serrations regularly spaced thereacross;

a clamp locator block releasably attached to said clamping member, said locator block having a vertical, generally planar face with a plurality of serrations regularly spaced thereacross, said vertical face of said clamp locator block being releasably engaged with said vertical face of said clamping member;

a nest base;

said nest base having a second support member attached thereto, said second support member having a vertical, generally planar support face with a plurality of serrations regularly spaced thereacross;

a second clamping member releasably attached to said second support member and having a vertical, generally planar clamp face, said clamp face including a plurality of serrations regularly spaced thereacross, said serrations on said clamp face being releasably engaged with said serrations on said second support member thereby permitting vertical adjustment of the position of said second clamping member with respect to that of said second support member;

a nest locator releasably attached to said second clamping member, said nest locator block having a vertical, generally planar face with a plurality of serrations regularly spaced thereacross, said vertical face of said locator block being releasably engaged with said vertical face of said second clamping member;

said clamp base thereby permitting adjustment of the position of said clamp locator block along a horizontal axis and along a vertical axis prior to clamping said work piece, said nest base thereby permitting adjustment of the position of said nest locator block along a vertical axis prior to clamping said work piece.

7. The mechanism of claim 6 wherein the direction of the clamping force exerted by the clamp locator block toward the nest locator block is unchanged, notwithstanding positional adjustment of either said clamp locator block or said nest locator block.

8. The mechanism of claim 6 further including, as part of said clamp base, a third support member and a second clamp arm arranged in cascade with said first support member and said first clamp arm, said third support member and said second clamp arm each including a generally planar face having a plurality of radially disposed serrations formed therein, said third support member and said second clamp arm thereby permitting rotational adjustment of the position of said clamp locator block with respect to said nest locator block prior to clamping sheet metal parts therebetween.

9. The mechanism of claim 8 wherein the direction of the clamping force exerted by the clamp locator block toward the nest locator block is unchanged, notwithstanding positional adjustment of either said clamp locator block or said nest locator block.

* * * * *